United States Patent [19]

Berglund

[11] Patent Number: 4,543,179

[45] Date of Patent: Sep. 24, 1985

[54] ROTARY GRAIN CLEANER

[75] Inventor: Norman Berglund, Thunder Bay, Canada

[73] Assignee: Thunder Bay Northland Machinery Inc., Ontario, Canada

[21] Appl. No.: 650,561

[22] Filed: Sep. 13, 1984

Related U.S. Application Data

[63] Continuation of Ser. No. 413,688, Sep. 1, 1982, abandoned.

[30] Foreign Application Priority Data

Sep. 4, 1981 [CA] Canada ..... 385250

[51] Int. Cl.[4] ..... B07B 1/38; B07B 1/46

[52] U.S. Cl. ..... 209/30; 209/317; 209/332; 209/415; 209/412; 209/409

[58] Field of Search ..... 209/366.5, 367, 405, 209/30, 409, 412, 415, 315, 317, 332, 350; 403/161-163, 138, 79

[56] References Cited

U.S. PATENT DOCUMENTS

| | | | |
|---|---|---|---|
| 597,412 | 1/1898 | Hintz | 209/332 |
| 996,155 | 6/1911 | Spenst | 209/317 |
| 1,870,629 | 5/1930 | Ingraham | 209/332 |
| 2,130,834 | 9/1938 | Berry | 209/415 |
| 2,246,483 | 6/1941 | Dillon | 209/166.5 |
| 2,683,533 | 7/1954 | Paul | 209/315 |
| 2,852,248 | 2/1954 | Travilla et al. | 403/162 |
| 2,908,391 | 10/1959 | Frevert | 209/315 |
| 2,936,634 | 5/1960 | Ketting | 74/61 |
| 3,314,539 | 4/1967 | Hitchman | 209/332 |
| 3,422,955 | 1/1969 | Mock et al. | 209/315 |
| 3,452,868 | 7/1969 | Miller | 209/254 |
| 3,752,315 | 8/1973 | Hubach | 209/240 |
| 4,167,478 | 9/1979 | Salete | 209/366.5 |

FOREIGN PATENT DOCUMENTS

| | | | |
|---|---|---|---|
| 778238 | 2/1968 | Canada . | |
| 797059 | 10/1968 | Canada . | |
| 952346 | 8/1974 | Canada . | |
| 1031729 | 5/1978 | Canada | 209/366.5 |
| 790137 | 2/1958 | United Kingdom | 209/366.5 |

*Primary Examiner*—Frank W. Lutter
*Assistant Examiner*—Wm. Bond
*Attorney, Agent, or Firm*—Handal & Morofsky

[57] ABSTRACT

Rotary grain cleaning machines are well known. The present invention provides a grain cleaning machine comprising an aspirator unit and a screen unit. The screen unit has an inner frame assembly suspended from an outer frame assembly, inclined screen decks secured to the inner frame assembly and means for causing the inner frame assembly to rotate in a substantially circular path within the outer frame assembly.

4 Claims, 4 Drawing Figures

ROTARY GRAIN CLEANER

This invention relates to an apparatus for sorting particles of different sizes, and more particularly, for cleaning and sorting grain.

Rotary grain cleaning machines and sorting machines are known; however, many utilize spring or cable suspension. A disadvantage of such machines is excessive vibration. Other types utilize solid rod and universal joint suspension; however, such units are restricted in movement within the outer frame and require a great deal of inconvenient maintenance due to the excessive number of moving parts in difficult to reach locations.

An advantage of the present invention is that it overcomes some of the disadvantages of the prior art. It is an object of the present invention to utilize a suspension system which results in a smoother movement of the inner deck than found in prior art units. In addition, access to the suspension system is facilitated for easier maintenance.

The present invention provides an apparatus adapted for cleaning and sorting grain, comprising a conventional aspirator unit and a screen unit, said screen unit comprising a frame assembly and at least one screen deck adapted to be rotated within said frame assembly.

From another aspect, the present invention provides an apparatus adapted for sorting particles of different sizes, comprising an aspirator unit and a screen unit, said screen unit comprising a frame assembly; a screen means, said screen means being suspended from said frame assembly by means of hanger rods, each said hanger rod being connected to said screen means and said frame assembly respectively, by spherical seat bearings; and rotating means adapted to rotate said screen means within said frame assembly, whereby the rotation of said screen means sorts said particles admitted into said screen means.

From yet another aspect, the present invention provides an apparatus adapted for cleaning and sorting grain, comprising an aspirator unit and a screen unit, said screen unit including an outer frame assembly; an inner frame assembly suspended from said outer frame assembly by hanger rods connected to the said frame assembly by means of spherical seat bearings located on the said outer frame assembly and on the said inner frame assembly; inclined screen decks secured to the said inner frame assembly; and rotating means for rotating the said inner frame assembly in a substantially circular path within the said outer frame assembly.

In drawings which illustrate embodiments of the invention,

Figure 1:
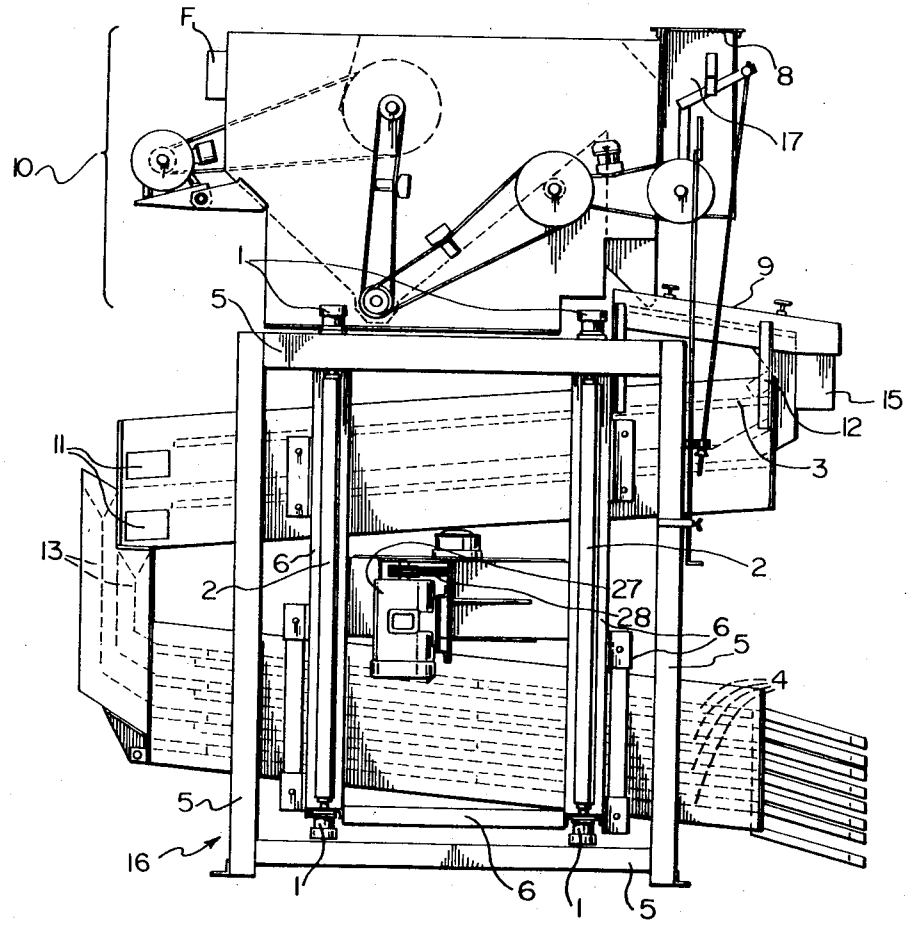
FIG. 1 is a side view in cross-section.
Figure 2:
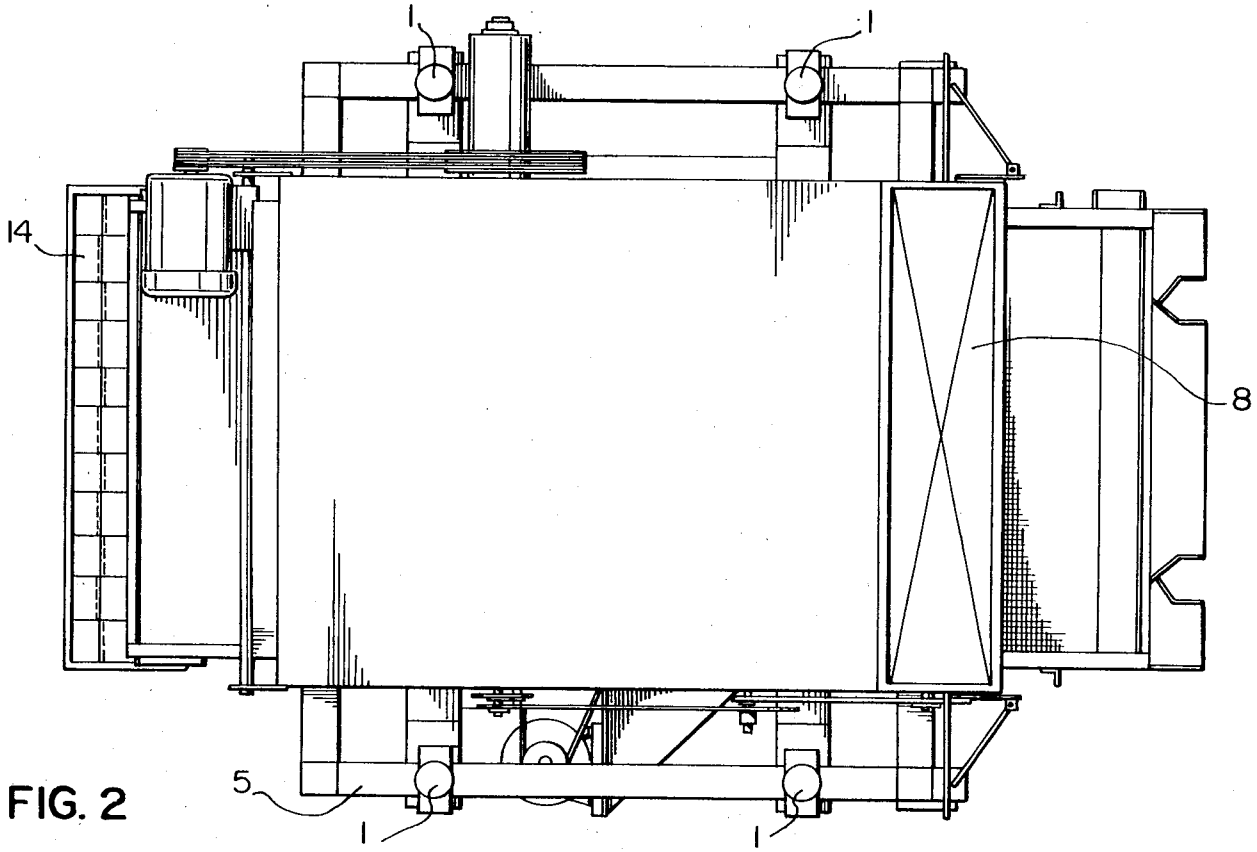
FIG. 2 is a top view.
Figure 3:
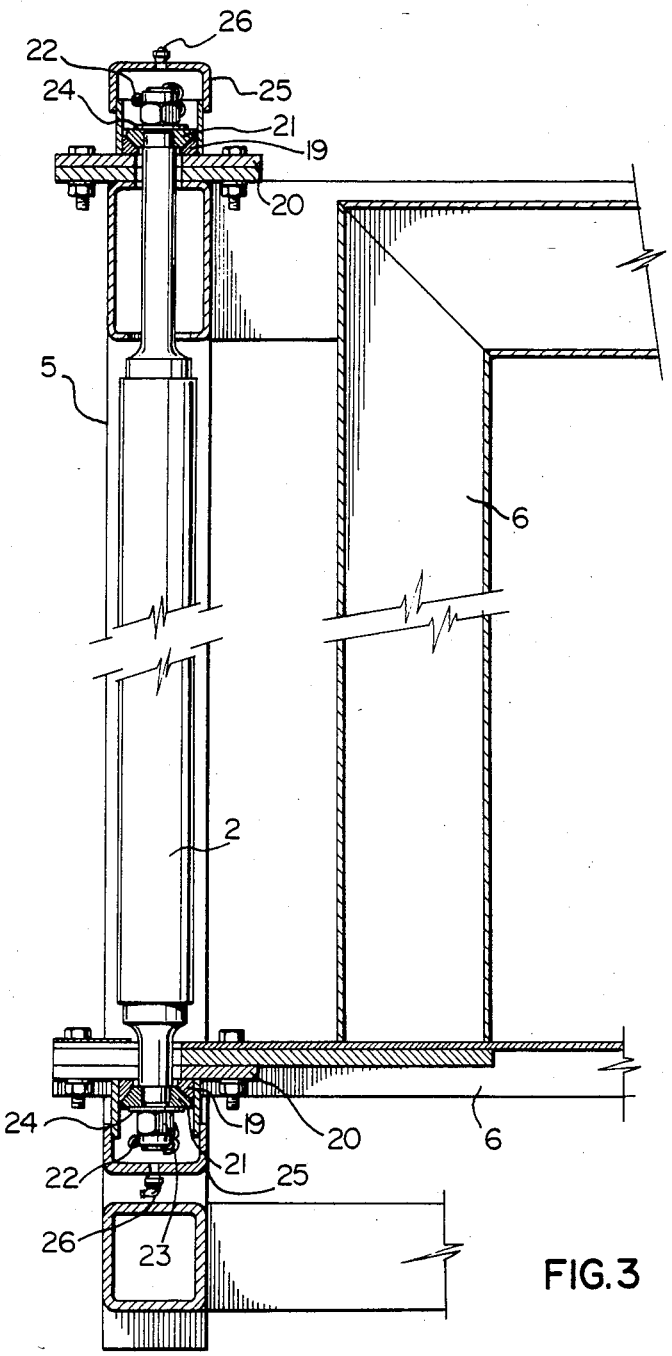
FIG. 3 is a side view of the bearings and hanger rods in cross-section.
Figure 4:
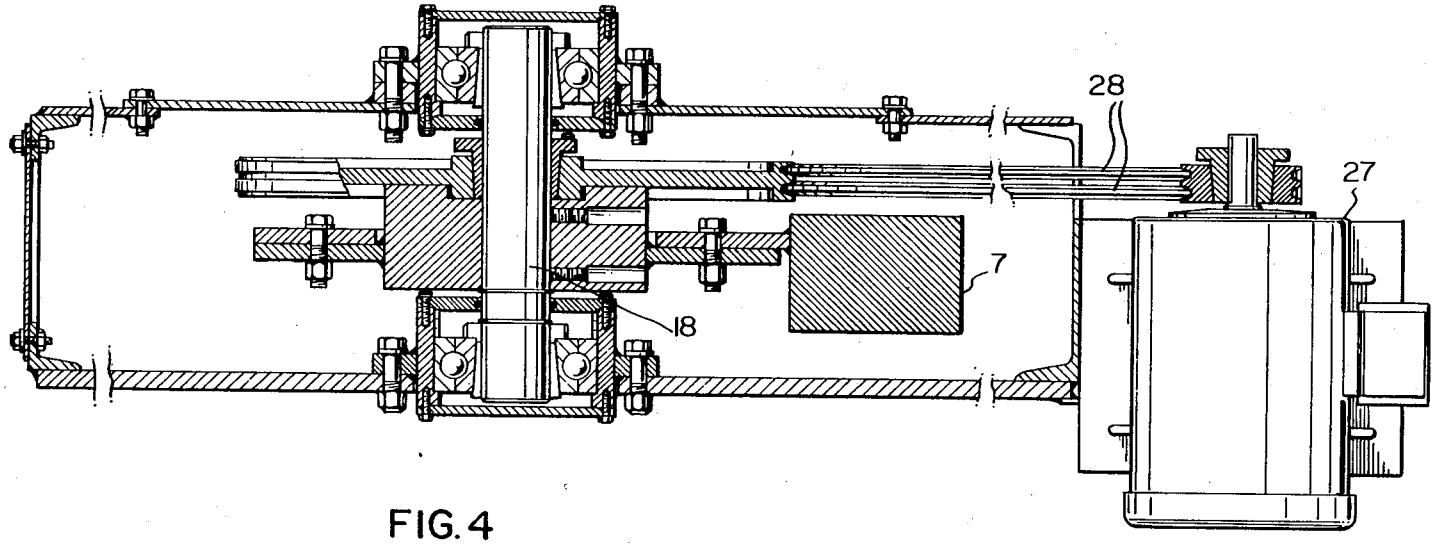
FIG. 4 is a cross-sectional view of rotating means and motor.

In a preferred embodiment the grain cleaner comprises two distinct units, a conventional aspirator unit 10 and a screen unit 16. The aspirator unit 10 is located at the top of the screen unit 16. The screen unit 16 is composed of two frames, an outer frame 5 and an inner frame 6. The outer frame 5 is stationary, and is structural and supporting in function. The inner frame 6 is free moving and is suspended from the outer frame 5 by four connecting hanger rods 2. Each rod extends from a top corner of the outer frame 5 to a bottom corner of the inner frame 6. The rods 2 are connected to the frames by the use of spherical seat bearings 1. The effect of this means of attachment is that the inner frame is free to move in a circular path within the outer frame. Motion of the inner frame 6 necessary to effect the movement of the grain down the screen decks is accomplished by the rotation of an eccentric weight 7 mounted on a revolving shaft 18 driven by belts 28 powered by an electric motor 27. Shaft 18, with weight 7, and motor 27 are all mounted on the inner frame 6. Since inner frame 6 is free to swing, rotation of weight 7 will cause inner frame 6 to counter-rotate.

The outer halves 19 of the spherical seat bearings 1 are affixed to rectangular plates 20 which are attached to the outer frame 5 and the inner frame 6 by means of nuts and bolts. The inner halves 21 of the spherical seat bearings 1 are affixed to the ends of the hanger rods 2 by means of cotter pins 22 and nuts 23 washer 24 is located between the inner half 21 of the bearing 1 and the nut 23. Each spherical seat bearing is encased in a bearing cap 25. Grease nipples 26 are used for the bearings 1 mounted on the inner frame 6 and outer frame 5, for easy maintenance.

In operation, grain is fed into the hopper 8 of the as pirator unit, passes down a chute 17, and lands on the rubble deck 9. At this point, a strong flow of air is blown through the grain by the aspirator unit, a light debris is carried away, through the aspirator unit and out of the machine at point F. Grain passes through the rubble deck onto a tray. Other, heavier debris is collected at point 15. The grain then passes through another short chute 12, where it is divided into two equal streams. Each stream of grain passes onto a screen of the upper screen deck 3. As the grain travels down these inclined screens, small and medium grains pass through the screens onto trays beneath the screens. Large grains do not pass through the screens and are collected at point 11. The small and medium grains then fall down two chutes 13, and are divided into four equal streams. Each stream then falls onto a separate screen of the lower screen deck 4. As the grain travels down these screens, small grains will pass through the screens, onto trays beneath the screens. At the end of the lower screen deck, the grain is discharged from the machine, sorted into small and medium sizes.

I claim:

1. An apparatus for sorting particles of different sizes comprising an aspirator unit for removing debris from among said particles, and a screen unit for receiving said particles from said aspirator unit and sorting said particles, said screen unit comprising:

(a) a rigid outer frame assembly;

(b) a rigid inner frame assembly suspended within said outer frame assembly by a plurality of rigid non-flexible vertical hanger rods, each said hanger rod being connected to an upper corner of said outer frame and a lower corner of said inner frame by a spherical seat bearing whereby said inner frame assembly can swing freely within said outer frame assembly;

(c) at least a pair of superposed, vertically spaced, inclined screen decks secured within said inner frame assembly the lower corner of said inner frame extending below the lowermost screen deck, each deck including at least one screen and one tray disposed beneath said screen and parallel thereto;

(d) rotating means mounted on said inner frame assembly in the space between said inclined screen decks, for rotating said inner frame within said outer frame, and agitating the particles on said screens.

2. An apparatus as described in claim 1, further comprising at least one chute connecting the lower end of the tray of the upper of said inclined decks with the upper end of the screen of the lower of said inclined decks, whereby particles admitted through the screen of said upper deck onto its associated tray is admitted onto the lower screen deck, for further sorting.

3. An apparatus as described in claim 2 wherein said rotating means is secured to said inner frame mid-way between said inclined decks.

4. An apparatus as described in claim 3 wherein said rotating means comprises a weight mounted on said inner frame for eccentric rotation on a horizontal plane within said inner frame and a motor mounted on said inner frame assembly for driving the rotation of said weight.

* * * * *